US005233139A

United States Patent [19]

Hofmann

[11] Patent Number: 5,233,139

[45] Date of Patent: Aug. 3, 1993

[54] MEASUREMENT OF TRACTION, OPERATION OF BRAKE, FRICTION SAFETY GEAR, AND CABLE FORCES OF AN ELEVATOR

[75] Inventor: Hans P. Hofmann, Neukeferloh, Fed. Rep. of Germany

[73] Assignee: Tuv Bayern E.V., Fed. Rep. of Germany

[21] Appl. No.: 484,569

[22] Filed: Feb. 23, 1990

[30] Foreign Application Priority Data

Apr. 7, 1989 [DE] Fed. Rep. of Germany ..... 3911391

[51] Int. Cl.[5] ..... B66B 3/00

[52] U.S. Cl. ..... 187/133

[58] Field of Search ..... 187/116, 131, 134, 133; 73/9

[56] References Cited

U.S. PATENT DOCUMENTS

| | | | |
|---|---|---|---|
| 2,886,137 | 5/1959 | Lund et al. | 187/131 |
| 3,973,648 | 8/1976 | Hummert et al. | 187/133 |
| 4,128,142 | 12/1978 | Satoh et al. | 187/116 |
| 4,427,095 | 1/1984 | Payne et al. | 187/134 |
| 4,738,337 | 4/1988 | Caputo | 187/116 X |
| 4,930,604 | 6/1990 | Schienda et al. | 187/133 |
| 4,936,136 | 6/1990 | Vanhala | 73/9 |

*Primary Examiner*—Steven L. Stephan

*Assistant Examiner*—Thomas M. Dougherty

*Attorney, Agent, or Firm*—Seed and Berry

[57] ABSTRACT

The present invention refers to a method of detecting of physical parameters, in particular parameters of motion, of a freight and/or of a passenger elevator whose elevator car is attached to a cable pull means driven by a traction sheave. The task to be solved by the present invention is the task of suggesting an examination method for examining such elevators, which reduces the expenditure of work in comparison with hitherto known examination methods and which increases the examination quality at the same time. In accordance with the present invention, this task is solved by the features that the physical parameters of the elevator are detected by connecting to the cable pull means and/or to the traction sheave at least one displacement pick-up for producing displacement signals, connecting the displacement pick-ups to an evaluation unit, which includes a timer, so as to supply the displacement signals to the evaluation unit, and connecting the evaluation unit to switching points of the control circuit, which have applied thereto signals controlling the sequence of motions of the elevator, so as to determine physical parameters on the basis of the displacement signals and the control signals. The method can be used in an advantageous manner for checking the driving capacity of the traction sheave.

14 Claims, 3 Drawing Sheets

Figure 1:
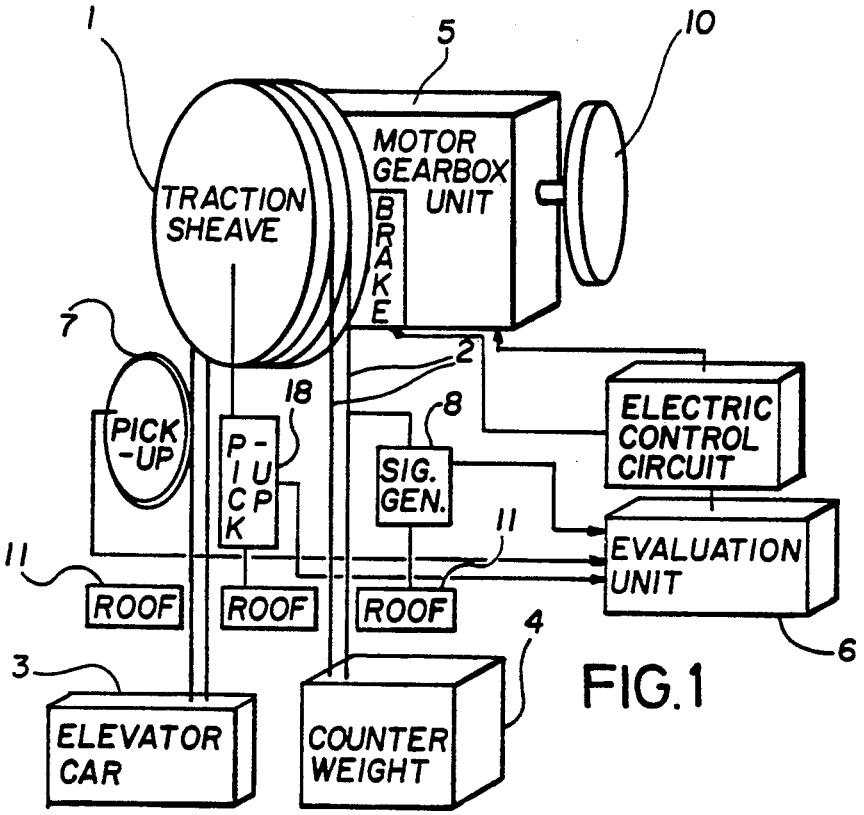

MEASUREMENT OF TRACTION, OPERATION OF BRAKE, FRICTION SAFETY GEAR, AND CABLE FORCES OF AN ELEVATOR

The present invention refers to a method of detecting physical parameters, in particular parameters of motion, of a freight and/or of a passenger elevator, said elevator comprising at least one cable pull means, which is guided across a traction sheave and which has attached thereto the elevator car at one end thereof and a counterweight at the other end thereof, and being driven by a drive motor, which acts on the traction sheave and which is controlled by an electric control circuit, and including a brake device, which is connected to the traction sheave and which is controlled by the control circuit.

The present invention is to be seen against the backdrop of safety tests for freight and passenger elevators. Such elevators have to be checked regularly, and these checks include a determination of e.g. parameters such as travelling distances, braking distances, emergency stopping distances and the resistance to skidding (driving capacity) of the cable pull means driven by the traction sheave.

Up to now the examination of elevators has required a high expenditure of work, since the examination of the effectiveness of the brake and of the emergency stopping device made it necessary to load the elevator with the admissible working load and, in cases in which the resistance to skidding was checked, even with one and a half times the working load. The loading and unloading of the respective weights is not only time-consuming, but it also necessitates heavy physical work. Moreover, the structural components of the elevator system are heavily stressed in the course of the weight test.

The present invention is based on the task of suggesting a method of examining freight and/or passenger elevators, which substantially reduces the expenditure of work required for the examination and which increases the examination quality at the same time.

In accordance with the present invention, this task is solved by the features that the physical parameters are detected by connecting to the cable pull means and/or to the traction sheave at least one displacement pick-up for producing displacement signals, connecting the displacement pick-ups to an evaluation unit, which is provided with a timer, so as to supply the displacement signals to the evaluation unit, and connecting the evaluation unit to switching points of the control circuit, which have applied thereto signals controlling the sequence of motions of the elevator, so as to form physical parameters on the basis of the displacement signals and the control signals.

In accordance with a method of this type, it is possible to determine kinematic data of the elevators, i.e. travelling distance values and associated time measuring values, in response to the signals controlling the sequence of motions of the elevator and with a low expenditure of work, the necessary test parameters being determinable on the basis of the kinematic data. It is, especially, possible to determine in an advantageous manner distances, speed and acceleration values from which the effectiveness of the brake as well as of an emergency stopping device, which is always provided in the case of elevators, can be derived.

In accordance with an expedient embodiment, the method according to the present invention includes the measure of connecting the cable pull means to a force measuring signal generator by means of which the forces, which are transmitted by the cable pull means and which determine the sequence of motions of the elevator car, can be detected. With the aid of such a force measurement, it will especially be possible to carry out in an advantageous manner the examination of the resistance to skidding of the cable pull means driven by the traction sheave.

It will be expedient when a computer, preferably a personal computer, is included in the method.

The examination method according to the present invention represents a substantial improvement also with regard to safety technology, since high loads acting on the elevator during the examination are avoided.

Additional advantageous possibilities of further developing the invention are disclosed by the subclaims.

Figure 2:
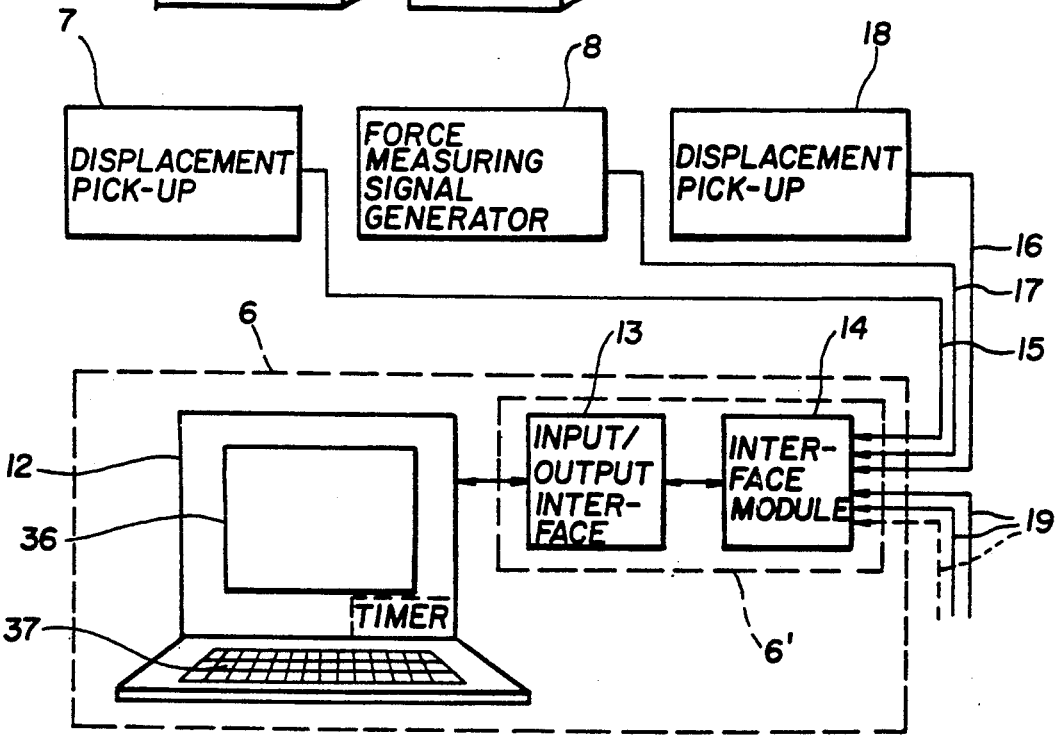
Figure 3:
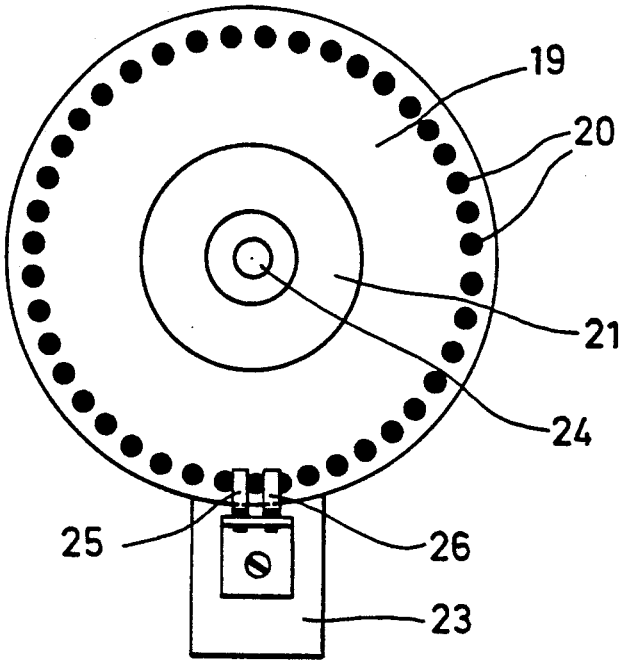
Figure 4:
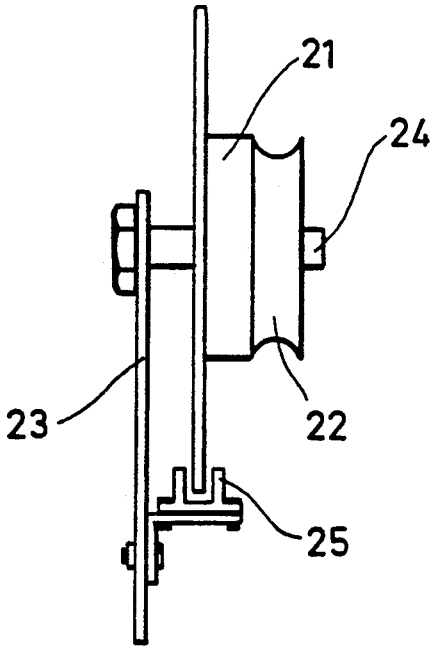
Figure 5:
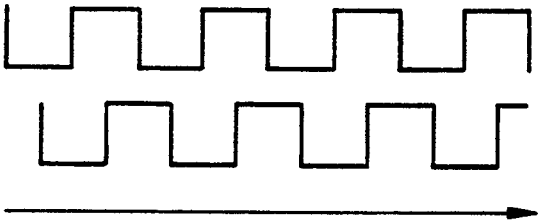
Figure 6:
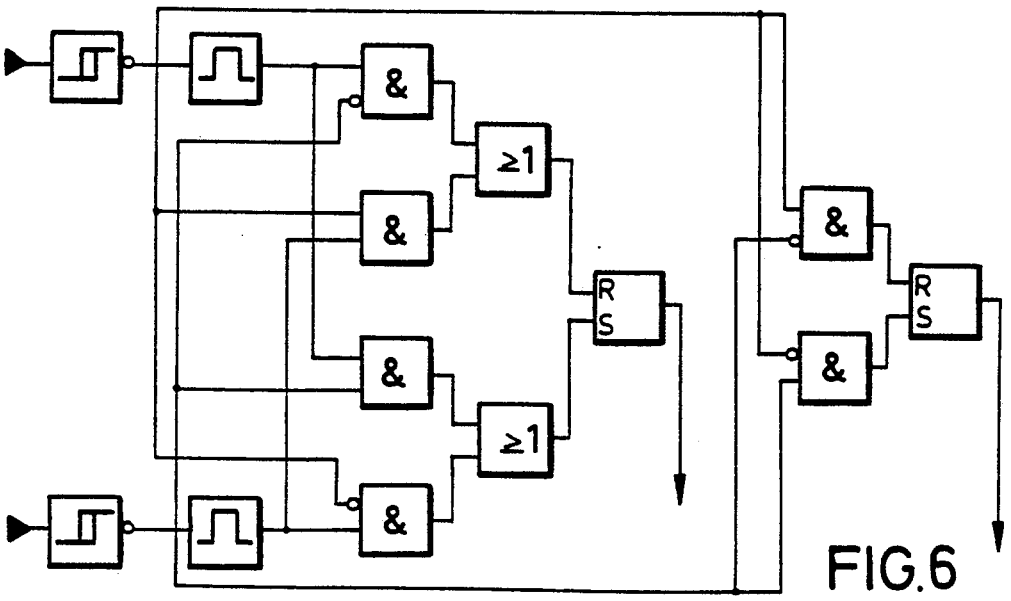
Figure 9:
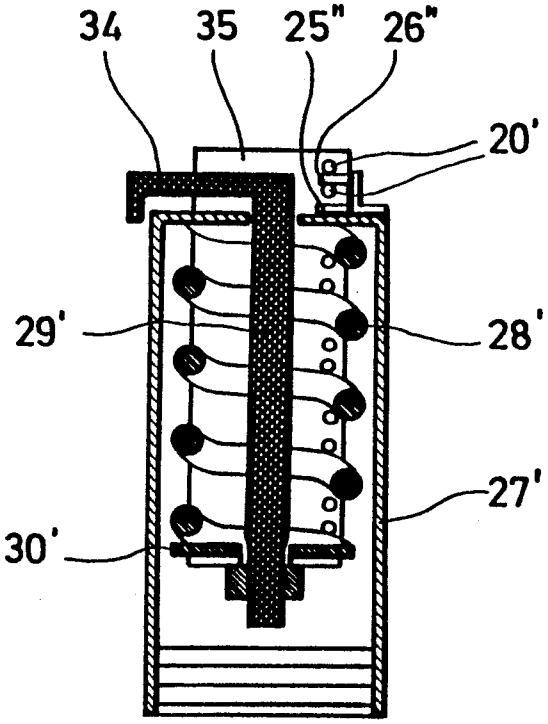
Figure 8:
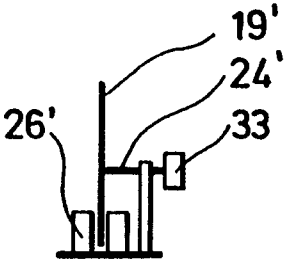
Figure 7:
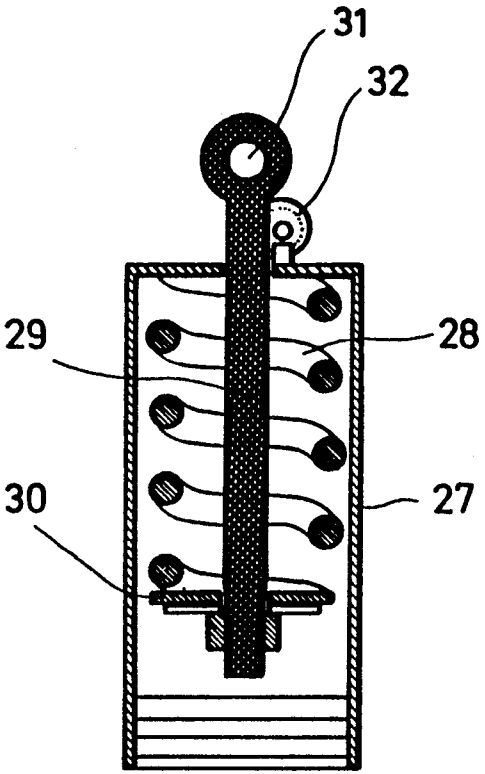

The present invention will now be explained and described in detail on the basis of embodiments and on the basis of the drawings enclosed, in which FIG. 1 shows an elevator system (schematically) for the examination of which the method according to the invention is provided incorporating an inventive apparatus, FIG. 2 shows an embodiment of an apparatus according to method as disclosed by the present invention, FIG. 3 shows a front view of an embodiment of a displacement pick-up adapted to be used in the case of the method according to the invention, FIG. 4 shows a side view of the displacement pick-up according to FIG. 3, FIG. 5 shows time diagrams of the measuring signals supplied by the displacement pick-up according to FIG. 3 and 4, FIG. 6 shows an evaluation circuit for the measuring signals supplied by the displacement pick-up according to FIG. 3 and 4, FIG. 7 shows an embodiment of a force measuring signal generator adapted to be used in the case of the method according to the invention, FIG. 8 shows a displacement pick-up used as a measuring transformer in the case of the force measuring signal generator according to FIG. 7, and FIG. 9 shows an additional embodiment of a force measuring signal generator adapted to be used in the case of the method according to the invention.

In order to provide a better basis for describing the method according to the present invention later on, an elevator system will first be described while making reference to FIG. 1, the method according to the present invention serving to examine said elevator system.

In FIG. 1, reference numeral 1 refers to a traction sheave having two guide grooves for a cable pull means 2 formed by two cables in the present case. One end of the cable pull means 2 has secured thereto an elevator car 3. The other end of said cable pull means 2 has attached thereto a counterweight 4. The mass of the counteweight 4 will normally correspond to the mass of the elevator car 3 plus half the admissible elevator car load. Reference numeral 5 refers to a motor-gearbox unit for driving the traction sheave 1, said unit being provided with a handwheel 10 for rotating the traction sheave 1. A brake device, which is not shown in FIG. 1, is arranged between the motor-gearbox unit 5 and the traction sheave 1. The motor-gearbox unit 5 plus the traction sheave 1 are arranged above a roof 11 defining an upward closure means of the elevator shaft.

When in operation, the elevator car 3 is moved via the cable pull means 2, which is driven by the motor-gearbox unit via the traction sheave 1. For operating the elevator system in a perfect manner, it will be necessary that the cable pull means is attached to the traction sheave such that sufficient resistance to skidding is provided. In emergency cases as well as in the case of repair work or checks, the elevator car can also be moved by means of the handwheel 10.

In FIG. 2, reference numeral 6 refers to an evaluation unit comprising a personal computer 12, an input-output interface 13 and an interface module 14 in the case of the present embodiment. The broken boundary line 6' is provided for indicating that the input-output interface 13 and the interface module 14 define a functional unit. The personal computer comprises, as is normally the case, a screen 36 as a display device and an input keyboard 37. In accordance with the arrows, which are shown in the figure and which interconnect the components, an exchange of data in both directions takes place between the individual components of the evaluation unit. In the present embodiment, the evaluation unit 6 is connected to a first displacement pick-up 7, which can communicate with one cable of the cable pull means 2, to a second displacement pick-up 18, which can communicate with the traction sheave 1, and to a force measuring signal generator 8, said connections being established via a respective one of the lines 15 to 17 in each case and said lines being connected to the evaluation unit via inputs provided on the interface module. Reference numeral 9 refers to lines through which the evaluation unit is connected to the control circuit of the elevator system. The lines 9 are, just as the lines 15 to 17, connected to inputs provided on the interface module 14.

In the case of the present embodiment, the lines 9 are combined so as to form a shielded 12-core cable having at one end thereof a testing plug, e.g. terminals adapted to be connected to the control circuit of the elevator system and at the other end thereof a circuit board plug provided with a voltage protection wiring.

The interface module 14 comprises four units. A control unit interface is provided for electric signals which are transmitted from the control circuit to the evaluation unit via said lines 9, said control unit interface having, for each input, an optical coupler for effecting a galvanic separation between the evaluation unit and the control circuit, an operational amplifier for signal amplification, which is to be operated with only one operating voltage and which is provided with a capacitive feedback, and a Schmitt trigger. A largely symmetrical sensor unit interface is provided for detecting and preprocessing signals of the displacement pick-ups and of the force measuring signal generator. Respective pulse-shaping Schmitt triggers are in this case used as input components, the respective outputs of said Schmitt triggers being applied to a monoflop having a small pulse width. Moreover, logic modules are provided for interconnecting signals from various inputs of the sensor unit interface. As a third unit, the interface module 14 includes a divider unit for dividing the system clock of the personal computer. Finally, the interface module includes an acoustic signal generator provided with a monoflop having a pulse width of approx. 500 ms and a piezoelectric buzzer following said monoflop.

The input-output interface comprises a decoder unit, an input-output unit and a timing unit. The timing unit includes a universally programmable counter whose clock input is connected to the system clock of the personal computer via the divider unit of the interface module.

FIG. 3 and 4 show a front view and a side view, respectively, of an embodiment of a displacement pick-up of a type which can be used in the case of the method of the present invention. The displacement pick-up is provided with a chopping disc 19 having provided therein equally spaced light passage openings 20, which are arranged concentrically around the centre of rotation of the chopping disc. The chopping disc is concentrically connected to a driving disc 21 provided with a guide groove for a driving cable of the cable pull means. The chopping disc 19 with the driving disc 21 has a rotating shaft 24, which is rotatably supported in a holding means 23. Reference numeral 25 refers to a first, and reference numeral 26 to a second light barrier measuring means whose light rays pass through the chopping disc and are interrupted by said chopping disc, respectively. The distance between the two light barriers and the distance between the light passage openings on the chopping disc were selected such that, when the chopping disc rotates in one direction, the pulse diagrams, which can be seen in FIG. 5 and which show time-staggered pulses, are obtained for the signals of the two light barrier means. The direction of rotation can be detected by evaluating the measuring signals provided by the two light barriers. Such an evaluation circuit is shown in FIG. 6. In addition to displacement pulses, whose number is characteristic of the distance covered by the elevator car, the circuit also provides a signal which indicates the direction of movement of the elevator car.

FIG. 7 shows an embodiment of a force measuring signal generator 8 which is adapted to be used in an arrangement according to FIG. 2. The force measuring signal generator comprises a helical compression spring 28, which is guided in a guide sleeve 27 and which is adapted to be compressed by a rod 29 having at one end thereof a disc 30, on which the spring 28 abuts, and at the other end thereof a loop 31. Reference numeral 32 refers to a displacement pick-up, which is adapted to be used for detecting a displacement of the rod 29 relative to the guide sleeve 27 and for supplying thus a measuring signal for the force acting on the rod. The displacement pick-up 32 is shown separately in FIG. 8. Just as the displacement pick-up according to FIG. 3 and 4, it comprises a chopping disc 19' and two light barrier measuring means 25' and 26' (25' cannot be seen in FIG. 8). The chopping disc 19' is connected to a driving wheel 33 via a rotating shaft 24', said driving wheel 33 abutting on the rod 29 and being driven by said rod.

FIG. 9 shows an additional embodiment of a force measuring signal generator, which differs from the embodiment according to FIG. 7 in so far as one end of the rod 29' is a hook 34 and in so far as there is provided a displacement pick-up for detecting the displacement of the rod 29' relative to the guide sleeve 27', said displacement pick-up being provided with a punched tape 35, which is connected to the rod 29' and adapted to be displaced relative to the guide sleeve and which is provided with light passage openings 20' arranged equidistantly in one line. For scanning the passage openings 20', a first light barrier means 25'' and a second light barrier means 26'' are provided.

The use of two light barriers in the case of each displacement pick-up for the force measuring signal generators permits a determination of the direction of movement of the rod.

The apparatus described on the basis of FIGS. 2 to 9 can be used for carrying out in accordance with the method according to the present invention measurements of speeds, accelerations and distances covered by the elevator car in response to the signals which control the movement of the elevator car and which come from the control circuit of the elevator system. It is thus possible to determine parameters, such as the braking distance, the emergency-stopping distance and the lifting height or the elevator car position, which are very important for the examination of elevators.

The new method can also be used for determining in an advantageous manner the resistance to slippage between the cable pull means and the traction sheare. For this purpose, the rod of the force measuring signal generator (of FIG. 7 or FIG. 9) will have to be connected to one or to several cables of the cable pull means with the aid of an appropriate cable clamp. The guide sleeve of the force measuring signal generator is secured to a fixed point, most expediently to the roof 11 closing the elevator shaft. By rotating the handwheel or moving the drive means, the force between the cable pull means and the traction sheave is to be increased during the slippage test until a limit value which has been ascertained will either be reached, whereupon the signal generator will produce a warning signal, or until the cable or the cables begin to slip on the traction sheave. The start of slippage at the maximum force which can be transmitted by the traction sheave, this being the force to be determined, can be registered by evaluating the signals of the first displacement pick-up, which is adapted to be connected between a fixed point and the cable pull means, and of the second displacement pick-up, which is adapted between a fixed point and be connected to the traction sheave, or it can be registered merely visually by the person examining the elevator.

In accordance with the method described, it is additionally possible to check the control circuit of the elevator by checking the sequence in time of the control signals. It is, for example, possible to determine the period of time which the control means needs for deactivating the drive means or for causing the brake to become effective after opening of a safety switch.

The evaluation unit 6 comprises a plurality of functional means (part of said functional means being realized as a software solution in the case of the present embodiment). One functional means is provided for determining the speed and/or acceleration values. The speed measurement and the acceleration measurement can be triggered by operating the keyboard of the personal computer or the triggering is effected by signals of the control circuit of the elevator. Measuring results can be displayed on the screen of the personal computer, and, if required, they can be outputted as a complete test log through a printer connected to the personal computer. In particular for the purpose of drawing attention to inadmissible measured values, there is the possibility of activating the acoustic signal generator, which is included in the interface module or in the personal computer such that it can be activated via the software. The screen can also be used for displaying information indicating how to operate the apparatus.

In the case of the embodiment described, the sensor interface is interrogated by the personal computer at very short time intervals and internal counters are actualized in response to changes, e.g. the advance movement of the chopping disc. For this purpose, it would also be possible to use a fixed bidirectional counter whose direction input is connected to a direction output of the sensor interface and whose clock input is connected to the clock output of the sensor interface. An interrogation of the counter can then be carried out by the computer via a parallel input-output unit at substantially larger intervals of time or said interrogation has to be carried out only once so as to ask for the final result. Moreover, it will then no longer be necessary that the interrogation is effected via a computer. There is the possibility of displaying these results through a conventional display unit. The necessary resetting of the counter can be effected by a computer or directly by a control interface or via a switch provided on the display unit.

In the case of the embodiment described hereinbefore, the values to be measured were converted directly into digital signals. As an alternative, there is the possibility of effecting data acquisition also in an analogous manner and of detecting e.g. speeds (and, consequently, also distances and accelerations) by means of a tachogenerator, or it is possible to detect forces by means of strain gauges or by means of piezoelectric pressure gauges. These analogues signals can be converted into digital signals by an A-D converter, and then they can be subjected to further processing by means of an evaluation unit.

I claim:

1. A method of detecting physical parameters of an elevator, such as parameters of motion, said elevator comprising at least one cable pull means, which is guided across a traction sheave and has attached thereto an elevator car at one end thereof and a counterweight at the other end thereof, said elevator being driven by a drive motor, which acts on the traction sheave and is controlled by an electric control circuit by the application of control signals to switching points of the control circuit, the control signals controlling the sequences of motion of the elevator, the method comprising the steps of:

(a) connecting a first displacement pick-up between the traction sheave and at least one cable of the cable pull means, the first displacement pick-up producing a displacement signal;

(b) connecting a force measuring signal generator to the cable pull means, the force measuring signal generator generating a force measuring signal; and (c) connecting an evaluation unit to the displacement pick-up, the switching points of the control circuit and the force measuring signal generator, the evaluation unit detecting the physical parameters on the basis of the displacement signal and the control signals and determining the maximum driving force which can be transmitted by the traction sheave to the at least one cable on the basis of the displacement signal and the force measuring signal.

2. A method according to claim 1, wherein step (c) includes determining the speed and acceleration values of the elevator by means included in the evaluation unit (6).

3. A method according to claim 2, wherein step (c) includes beginning to determine the maximum driving force upon the evaluation unit being triggered by the control signals.

4. A method according to claim 1, wherein step (c) includes beginning to detect the physical parameters and/or to determine the maximum driving force upon the evaluation unit being triggered by a keyboard included in the evaluation unit.

5. A method according to claim 1, further comprising the step of (d) displaying the physical parameters detected and/or the maximum driving force determined on a screen display means.

6. A method according to claim 5, wherein step (d) comprises displaying displacement distances, speed values, acceleration values and the maximum force on the screen display means.

7. A method according to claim 1, further comprising the step of (e) producing warning signals in response to evaluation results with the aid of signalling means included in the evaluation unit.

8. A method according to claim 1, wherein step (a) includes producing the displacement signal by scanning a chopping disc with the aid of at least one light barrier, said chopping disc being adapted to be rotated in accordance with a displacement length to be measured by being driven by a driving roll which is pressed against the cable pull means.

9. A method according to claim 8, wherein step (a) further includes driving the driving roll by the cable pull means by inserting said cable pull means into a guide groove of said driving roll.

10. A method according to claim 1, wherein step (b) includes using a spring-type measuring element to generate the force measuring signal as a function of change in the length of a spring.

11. A method according to claim 10, wherein step (b) further includes detecting the spring length change with the aid of a second displacement pick-up.

12. A method according to claim 11, wherein step (b) further includes detecting the spring length change by detecting the rotational change of a chopping disc, the excursion change of said chopping disc being scanned with a light beam relative to at least one light barrier, so as to determine displacement signals that measure the spring length change.

13. A method according to claim 12, further comprising the steps of:

(g) supplying the displacement signal produced by the first displacement pick-up and the force measuring signals produced by the spring-type measuring element to an interface module; and (h) connecting the interface module between the control circuit and an input-output interface of a personal computer, the displacement signal and force measuring signal being preprocessed by the interface module.

14. A method according to claim 1, wherein step (a) includes producing the displacement signal by scanning a chopping disc with the aid of at least one light barrier, said chopping disc being adapted to be rotated in accordance with a displacement length to be measured by driving the chopping disc with the traction sheave.

* * * * *